US009495940B2

(12) United States Patent
Hoshino et al.

(10) Patent No.: US 9,495,940 B2
(45) Date of Patent: Nov. 15, 2016

(54) KEYBOARD DEVICE AND KEYBOARD INSTRUMENT

(71) Applicant: CASIO COMPUTER CO., LTD., Tokyo (JP)

(72) Inventors: Akihisa Hoshino, Tokyo (JP); Hirokazu Taniguchi, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/657,982

(22) Filed: Mar. 13, 2015

(65) Prior Publication Data

US 2015/0269914 A1 Sep. 24, 2015

(30) Foreign Application Priority Data

Mar. 20, 2014 (JP) ..... 2014-058180
Mar. 20, 2014 (JP) ..... 2014-058185

(51) Int. Cl.
*G10C 3/18* (2006.01)
*G10C 3/12* (2006.01)
*G10H 1/34* (2006.01)

(52) U.S. Cl.
CPC . *G10C 3/18* (2013.01); *G10C 3/12* (2013.01); *G10H 1/346* (2013.01)

(58) Field of Classification Search
CPC ..... G10C 3/161; G10C 3/18; G10C 3/22; G10H 1/346
See application file for complete search history.

(56) References Cited

U.S. PATENT DOCUMENTS 782,428 A * 2/1905 Struble et al. ..... E05D 7/1066 16/267
4,603,452 A * 8/1986 Paciorek ..... E05D 7/10 16/262
4,774,868 A * 10/1988 Finholm ..... G10C 3/22 84/239
5,070,577 A * 12/1991 Bonneville ..... B65D 11/1833 16/260
5,269,046 A * 12/1993 Newby, Sr. ..... E05D 7/1072 16/267
5,357,565 A * 10/1994 Butler, III ..... E05D 11/0054 16/250

(Continued)

FOREIGN PATENT DOCUMENTS

JP 2002-258835 A 9/2002

*Primary Examiner* — Robert W Horn
(74) *Attorney, Agent, or Firm* — Chen Yoshimura LLP

(57) ABSTRACT

A keyboard device including a plurality of wippens that respectively rotate in the vertical direction in response to the respective depressions of the plurality of keys aligned alongside each other, a plurality of hammers that swing in response to the respective rotation of the plurality of wippens and then respectively add an action load to the plurality of keys, and a wippen holding member having a plurality of wippen flanges that are integrally formed along a direction in which the keys are aligned and that rotatably hold the respective plurality of wippens. Therefore, the plurality of wippen flanges do not need to be individually manufactured and assembled, and thus the plurality of wippen flanges can be easily disposed at once by just installing the wippen holding member.

18 Claims, 11 Drawing Sheets

(56) References Cited

U.S. PATENT DOCUMENTS 5,455,987 A * 10/1995 Svehaug ..... E05D 7/1072 16/267
5,635,655 A * 6/1997 Yamashita ..... G10C 3/02 220/827
5,834,668 A * 11/1998 Kumano ..... G10H 1/346 84/423 R
6,509,517 B1 * 1/2003 Wroblewski ..... G10C 3/22 84/216
6,740,801 B2 * 5/2004 Yoshisue ..... G10C 3/22 84/423 R
7,141,728 B2 * 11/2006 Yoshisue ..... G10C 9/00 84/236
7,365,259 B2 * 4/2008 Nishida ..... G10H 1/346 84/423 R
7,586,030 B2 * 9/2009 Nishida ..... G10C 3/12 84/423 R
8,076,563 B2 * 12/2011 Kamimura ..... G10C 3/12 84/423 R
8,110,732 B2 * 2/2012 Shimoda ..... G10C 3/12 84/423 R
8,119,895 B2 * 2/2012 Kitajima ..... G10H 1/34 84/423 R
8,134,060 B2 * 3/2012 Taniguchi ..... G10H 1/346 84/423 R
8,440,896 B2 * 5/2013 Hoshino ..... G10C 3/12 84/423 R
8,584,319 B1 * 11/2013 Ludin ..... E05D 7/10 16/262
9,006,549 B2 * 4/2015 Suzuki ..... G10H 1/34 84/423 R
9,122,078 B2 * 9/2015 Calilung ..... G02C 5/22
9,324,306 B2 * 4/2016 Hoshino ..... G10C 3/22
9,384,715 B2 * 7/2016 Taniguchi ..... G10C 3/18
2002/0121183 A1 9/2002 Inoue et al.
2003/0038142 A1 * 2/2003 Gee ..... A45C 13/005 220/835
2003/0066165 A1 * 4/2003 Hansen, II ..... E05D 5/125 16/266
2005/0103797 A1 * 5/2005 Rader ..... B65D 43/165 220/844
2008/0083862 A1 * 4/2008 Salatka ..... A47G 29/083 248/308
2008/0245216 A1 * 10/2008 Kojima ..... G01P 3/50 84/688
2010/0181438 A1 * 7/2010 Chauzu ..... H02G 3/0456 248/49
2012/0111176 A1 * 5/2012 Taniguchi ..... G10H 1/346 84/423 R
2013/0152769 A1 * 6/2013 Suzuki ..... G10H 1/34 84/719
2015/0269914 A1 * 9/2015 Hoshino ..... G10C 3/18 84/240
2015/0269915 A1 * 9/2015 Taniguchi ..... G10C 3/18 84/236

* cited by examiner

KEYBOARD DEVICE AND KEYBOARD INSTRUMENT

CROSS-REFERENCE TO RELATED APPLICATIONS

This application is based upon and claims the benefit of Japanese Patent Application No. 2014-058143, filed Mar. 20, 2014, which is hereby incorporated by reference in its entirety.

BACKGROUND OF THE INVENTION

1. Technical Field

This invention relates to keyboards and keyboard instruments such as pianos.

2. Background Art

For example, Japanese Patent Application Laid-Open Publication No. 2002-258835 discloses a keyboard instrument having a structure with a plurality of keys respectively including a wippen that rotates when a key is depressed, a jack that is driven by the wippen swinging, and a hammer that strikes a string after being driven by the jack.

This type of keyboard instrument includes a wippen rail and a hammer rail respectively running the entire length of the plurality of keys in the array direction of the plurality of keys.

A plurality of wippen flanges that corresponds to respective keys are attached to the wippen rail, and a plurality of wippens are respectively attached to the wippen flanges by pins such that the wippens can swing.

A plurality of hammer flanges are respectively attached to the plurality of wippens on the hammer rail. Respective hammer shanks of the plurality of hammers are attached to the hammer flanges with pins such that the hammer shanks can swing.

This type of keyboard instruments needs the wippen to be individually attached to the wippen flange with a pin. Therefore, when the plurality of wippens are being attached to the wippen rail, the plurality of wippens need to be individually attached to the wippen rail one after another according to the attaching procedure for attaching a plurality of wippens. This results in problems such as the assembly process being tedious, productivity being low, and the cost being high.

Furthermore, the hammer of this keyboard instrument needs to be individually attached to the hammer flanges with a pin. Therefore, when a plurality of hammers are being attached to the hammer rail, the plurality of hammer flanges need to be individually attached to the hammer rail one after another. This result in problems such as the assembly process being tedious, productivity being low, and the cost being high.

In addition, recently, applying this type of action that adds a more realistic key touch to electronic keyboard instruments that produce a hammer struck string sound using an electronic sound source circuit is being proposed.

In ordinary electronic keyboard instruments, a switch is provided under each key to detect the depressing and releasing of keys, or the velocity of the key depressing. However, if this type of action is included in such electronic keyboard instruments, a new problem emerges.

That is, the switch provided for each key is a component that receives the most mechanical load when the keys are used, and malfunctions often. As a result, the switch needs frequent repair and replacement. Conventionally, the keys could have been repaired or replaced relatively easily by removing the keys or the like, but if the keyboard has the above-mentioned type of mechanism, repairing and replacing keys becomes more difficult.

In addition, recently, applying this type of action that adds a more realistic key touch to electronic keyboard instruments that produces the hammer struck string sound using an electronic sound source circuit is being proposed. In this case, the usage of resins or the like that has a material property that is lighter and allows higher productivity than regular cast metal is proposed as the material of the bracket, which is a supporting member that supports the hammer and the wippen.

However, the bracket supports the entire action mechanism, and therefore a bracket using resin or the like had insufficient strength compared to conventional brackets made of cast metal.

Furthermore, the keyboard is structured such that the supporting member such as a bracket is supported by a plurality of long rails, and therefore, even if a material that is light and high in productivity such as resin is used, the supporting member such as a bracket can maintain sufficient strength.

SUMMARY OF THE INVENTION

Accordingly, the present invention is directed to a keyboard and a keyboard instrument that is easy to assemble, has good productivity, and can reduce cost.

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a keyboard device having: a plurality of keys; and a plurality of key action mechanisms respectively provided for the plurality of keys, wherein each of the key action mechanisms includes: a wippen swing axis; a wippen that has a wippen engaging part that swingably couples with the wippen swing axis by being inserted removably to the wippen swing axis, the wippen being coupled to the wippen swing axis so as to swing about the wippen swing axis in response to a depression of the corresponding key; and a hammer that swings in response to the swing of the wippen triggered by the depression of the key so as to apply a load to the key when the key is depressed.

In another aspect, the present disclosure provides a keyboard device having: a plurality of keys; and a plurality of key action mechanisms respectively provided for the plurality of keys, wherein each of the key action mechanisms includes: a wippen that shifts in response to a depression of the corresponding key; a hammer swing axis; a hammer having a hammer engaging part that swingably couples with the hammer swing axis by being inserted removably to the hammer swing axis, the hammer being coupled to the hammer swing axis so as to swing about the hammer swing axis in response to a depression of the key so as to apply a load to the key when the key is depressed.

In another aspect, the present disclosure provides a keyboard device having: a plurality of keys; and a plurality of key action mechanisms respectively provided for the plurality of keys, wherein each of the key action mechanisms includes: a wippen swing axis; a wippen that has a wippen engaging part that swingably couples with the wippen swing axis by being inserted removably to the wippen swing axis, the wippen being coupled to the wippen swing axis so as to swing about the wippen swing axis in response to a depression of the corresponding key; a hammer swing axis; and a hammer having a hammer engaging part that swingably couples with the hammer swing axis by being inserted removably to the hammer swing axis, the hammer being coupled to the wippen swing axis so as to swing about the hammer swing axis in response to a depression of the key to apply a load to the key when the key is depressed.

It is to be understood that both the foregoing general description and the following detailed description are exemplary and explanatory, and are intended to provide further explanation of the invention as claimed.

BRIEF DESCRIPTION OF THE DRAWINGS

FIGS. 5A and 5B show respective portions of the wippen holding member and the jack, in which FIG. 5A is an enlarged plan view and FIG. 5B is an enlarged cross-sectional view along arrow B-B.

FIGS. 6A and 6B show the wippen holding member and the wippen shown in FIG. 2, in which FIG. 6A is an enlarged side view of the wippen and FIG. 6B is an enlarged bottom view of the wippen.

FIGS. 7A and 7B show a process of attaching the wippen to the wippen holding member shown in FIG. 2, in which FIG. 7A is an enlarged side view showing a state in which the wippen holding member is positioned above the wippen in an upright state, and FIG. 7B is an enlarged side view showing a state in which the wippen attached to the wippen holding member is positioned above the key after being rotated clockwise.

FIGS. 8A and 8B show respective portions of the hammer butt and the hammer, in which FIG. 8A is an enlarged plan view and FIG. 8B is an enlarged cross-sectional view along arrow C-C.

FIGS. 10A and 10B show an enlarged side view of a process of attaching the hammer to the hammer butt shown in FIG. 2, in which FIG. 10A is an enlarged side view showing the hammer in an upright state in a position above the hammer butt and FIG. 10B is an enlarged side view of the hammer being attached to the hammer butt and being rotated counterclockwise such that the hammer is positioned above the wippen.

FIGS. 11A and 11B show Modification Example 1 of an engaging part of a wippen and a wippen swing axis of a wippen holding member, in which FIG. 11A is an enlarged side view of main components showing a state in which the wippen engaging part is engaged to the wippen swing axis and FIG. 11B is an enlarged side view of main components showing a state in which the wippen engaging part is engaged to the wippen swing axis and is rotated clockwise.

FIGS. 12A and 12B show Modification Example 2 of a hammer engaging part of the hammer and a hammer swing axis of the hammer butt, in which FIG. 12A is an enlarged side view of the main components showing a state in which the hammer engaging part is engaged to the hammer swing axis and FIG. 12B is an enlarged side view of the main components in which the hammer engaging part is engaged to the hammer swing axis and rotated counterclockwise.

DETAILED DESCRIPTION OF EMBODIMENTS

An embodiment in which the electronic keyboard instrument of one aspect of the present invention is applied is described with reference to FIGS. 1 to 10.

Figure 1:
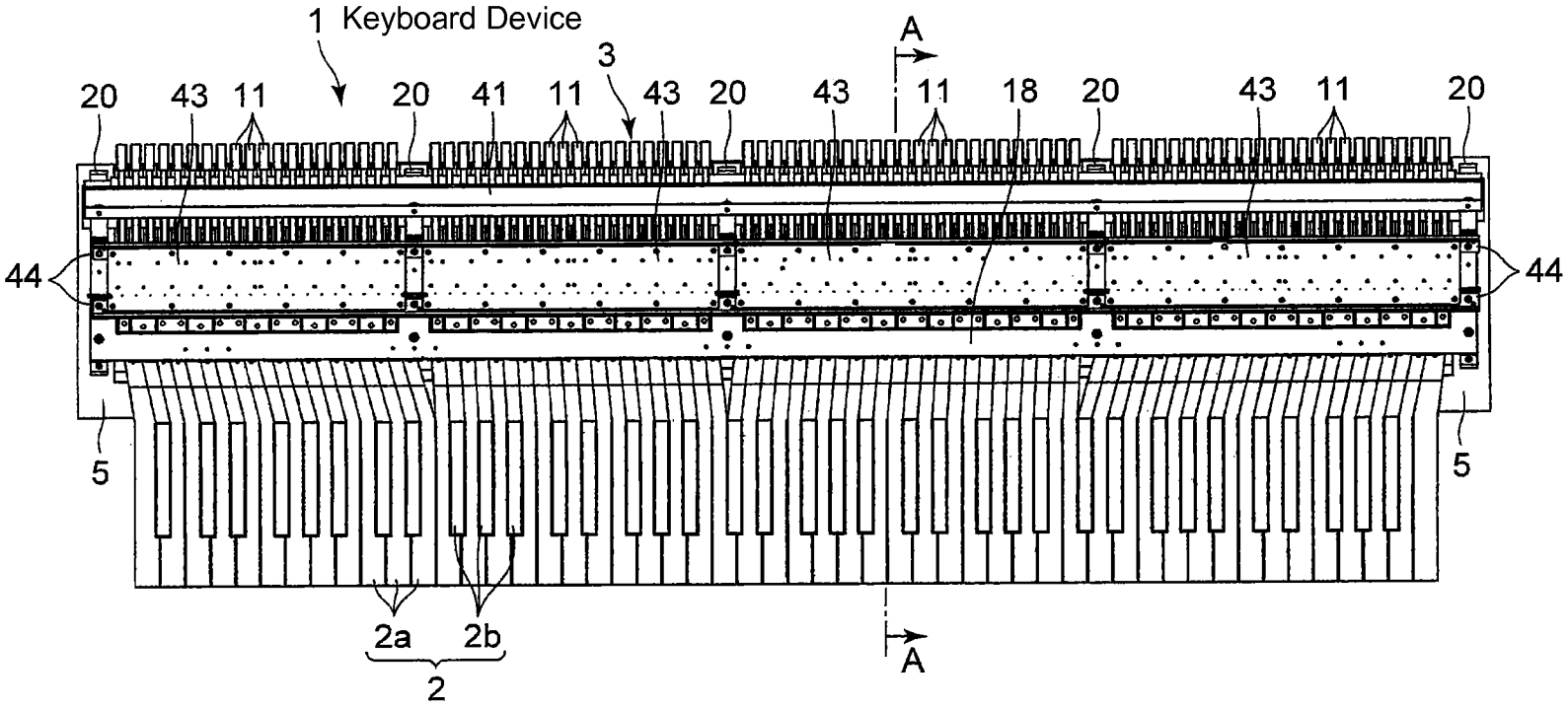
FIG. 1 shows a plan view of an embodiment in which this invention was applied to an electronic keyboard instrument.
Figure 2:
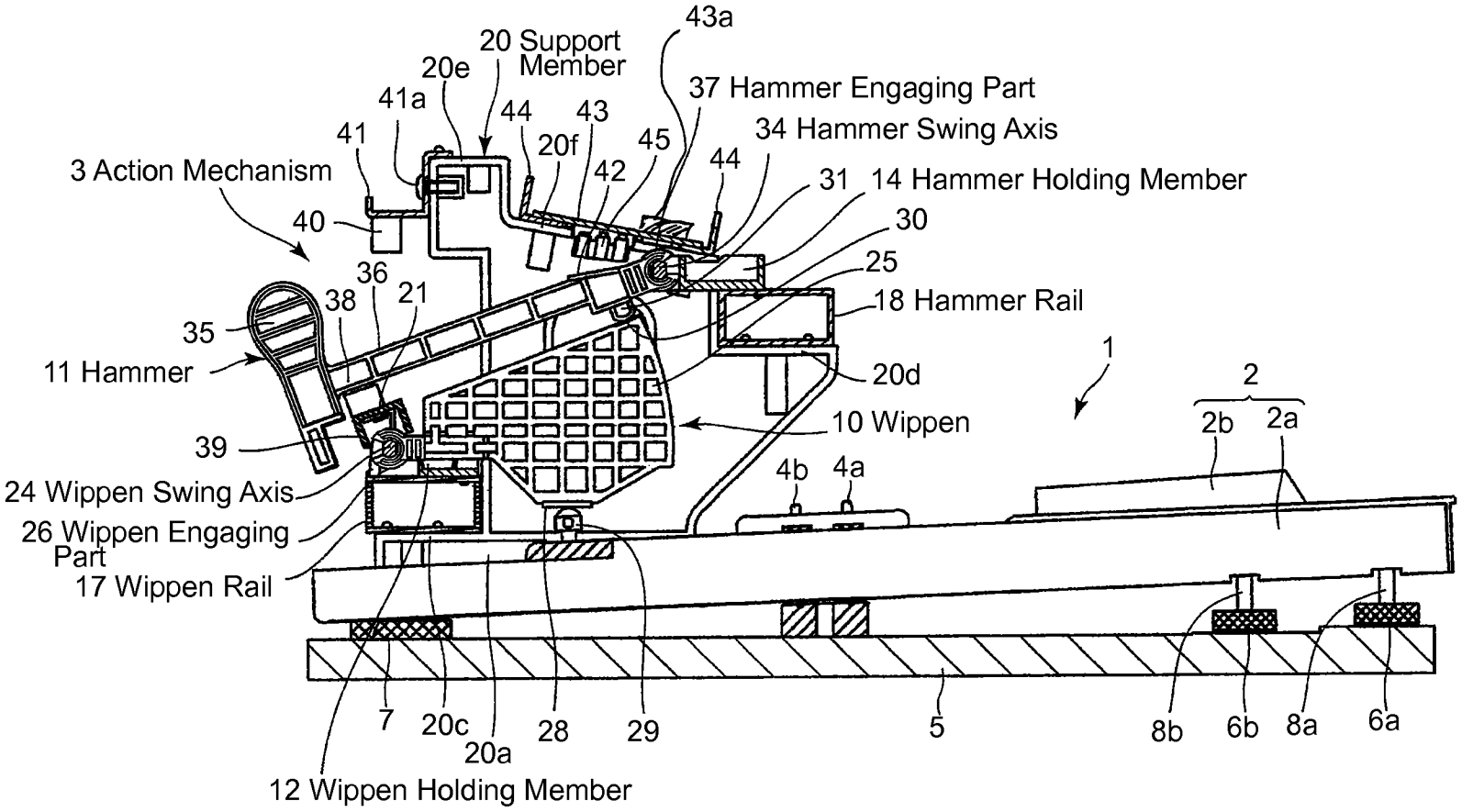
FIG. 2 is an enlarged side view along arrow A-A of a keyboard instrument shown in FIG. 1.

As shown in FIGS. 1 and 2, this electronic keyboard instrument has a keyboard device 1. This keyboard device 1 is assembled into an instrument case (not shown). The keyboard device 1 has a plurality of keys 2 that are aligned and has an action mechanism 3 that applies an action load to the respective keys 2 corresponding to a key depressing operation.

As shown in FIGS. 1 and 2, the plurality of keys 2 include white keys 2*a* and black keys 2*b*, and 88 of these white keys 2*a* and black keys 2*b* are aligned. These plurality of keys 2 are aligned on a base plate 5 such that an approximately middle portion of the keys in the front and back direction (horizontal direction in FIG. 2) is supported by balance pins 4*a* and 4*b* in a manner in which the keys can swing in the vertical direction.

In this case, as shown in FIG. 2, cushion materials 6*a* and 6*b* are provided on a base plate 5 along the alignment direction of the keys 2 such that the respective bottom surfaces of respective front edge portions (right edge portion in FIG. 2) of the plurality of keys 2 can come into contact with and move away from the cushion materials 6*a* and 6*b*. Furthermore, a cushion material 7 is provided on the base plate 5 along the alignment direction of the keys 2 such that each of the bottom surfaces of respective back edge portions of the keys 2 can come into contact with and move away from the cushion material 7. In addition, guide pins 8*a* and 8*b* for preventing the plurality of keys 2 from horizontally oscillating in the alignment direction thereof are inserted and directed upward.

As shown in FIGS. 1 and 2, the action mechanism 3 has a plurality of wippens 10 that respectively rotate in a vertical direction corresponding to the depression of the plurality of keys 2 and has a plurality of hammers 11 that apply an action load to the keys 2 when rotating in accordance with the vertical rotation of the wippens 10.

As shown in FIG. 2, this action mechanism 3 includes the wippen holding member 12 that is a plurality of wippen flanges 13 that hold the plurality of wippens 10 such that the wippens can rotate freely and that are integrally formed in the key 2 arrangement direction, and the hammer butt 14 that is a plurality of hammer flange 15 that hold the plurality of hammers 11 such that the hammers 11 can rotate freely and that are integrally formed in the key 2 arrangement direction.

Figure 3:
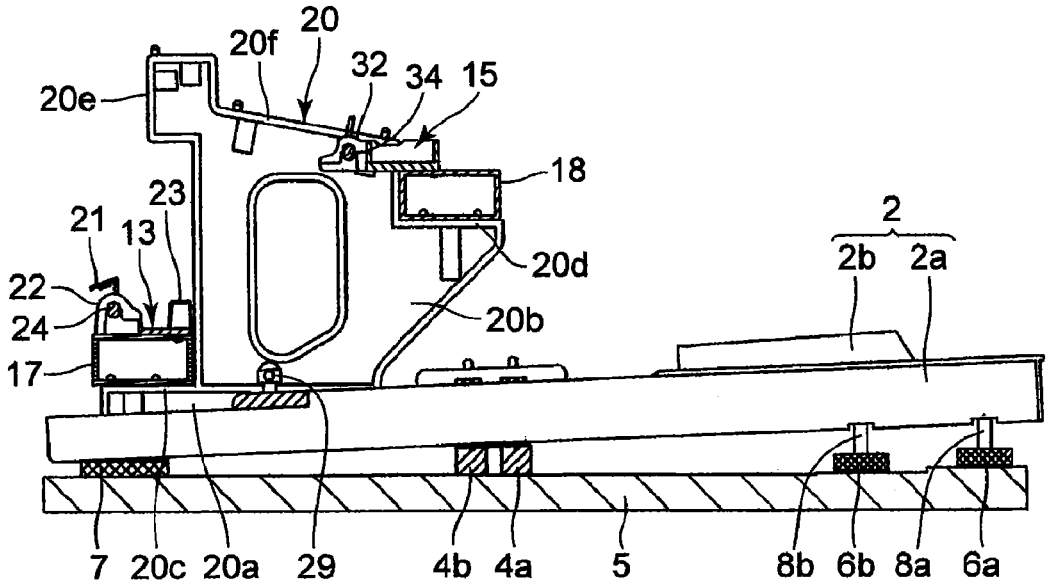
FIG. 3 is an enlarged side view showing the keyboard instrument shown in FIG. 2 having a wippen rail and a hammer rail disposed on a plurality of supporting members across the entire length of a plurality of keys in the key arrangement direction.

In this case, as shown in FIGS. 2 and 3, the wippen holding member 12 is attached on the wippen rail 17 along the key 2 arrangement direction. Furthermore, the hammer butt 14 is attached on the hammer rail 18 that is disposed along the key 2 arrangement direction. These wippen rails 17 and the hammer rails 18 are supported by the plurality of supporting members 20 and are disposed above the plurality of keys 2.

As shown in FIGS. 1 to 4, the plurality of supporting members 20 are respectively attached in an upright state on the base plate 5 in a plurality of locations along the entire length of the plurality of keys 2 in the key 2 arrangement direction. In this case, 88 keys are arranged in total as the plurality of keys 2, for example. Thus, the plurality of supporting members 20 are disposed on both edges of the keyboard device 1 in the key 2 arrangement direction and are provided on three locations between two adjacent keys 2 for every 20 keys 2, for example. In other words, in this embodiment, the supporting members 20 are provided in five locations along the entire length of the plurality of keys 2 in the key 2 arrangement direction.

Figure 4:
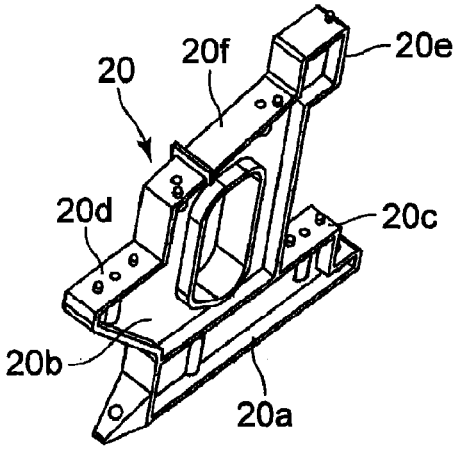
FIG. 4 is an enlarged perspective view of a supporting member shown in FIG. 3.

This supporting member 20 is formed of a hard synthetic resin such as an ABS resin, and as shown in FIGS. 3 and 4, the supporting member 20 has an attaching part 20*a* that is attached on the base plate 5 and a bridging part 20*b* that is formed integrally on the attaching part 20*a*. As a result, the supporting member 20 is configured such that the attaching part 20*a* is attached on the base plate 5, such that the bridge part 20*b* is positioned above the keys 2 between the respective back portions of the plurality of keys 2.

In this case, as shown in FIGS. 3 and 4, a back side rail supporting member 20*c* that supports the wippen rail 17 is provided on the lower back portion of the bridging portion 20*b*, or in other words, on the upper back portion of the attaching portion 20*a* (upper left side in FIG. 3). In addition, a front side rail supporting member 20*d* that supports the hammer rail 18 is provided on the upper front side (upper right side in FIG. 3) of the bridging part 20*b*. In addition, a stopper rail supporting part 20*e* is provided on the upper back side of the bridging part 20*b* and a substrate rail supporting part 20*f* is provided on the upper portion of the bridging part 20*b*.

As shown in FIGS. 2 and 3, the wippen rail 17 is a metal such as aluminum, or the like, and the cross-section of the wippen rail 17 is in a rectangular cylindrical shape and has a length that extends across all of the keys 2 in the key 2 arrangement direction. The wippen rail 17 is configured such that prescribed locations thereof in the key 2 arrangement direction are attached to the respective back side rail supporting members 20*c* of the plurality of supporting members 20.

As shown in FIGS. 2 and 3, the plurality of wippen holding members 12 and a plurality of stopper supporting members 21 are attached along the key 2 arrangement direction. In this case, as shown in FIG. 3, the plurality of stopper supporting members 21 are formed of a metal plate, and are attached on five locations on the wippen rail 17 that corresponds to the plurality of supporting members 10 such that the stopper supporting members 21 protrude above the plurality of wippen holding members 12.

Figure 5A:
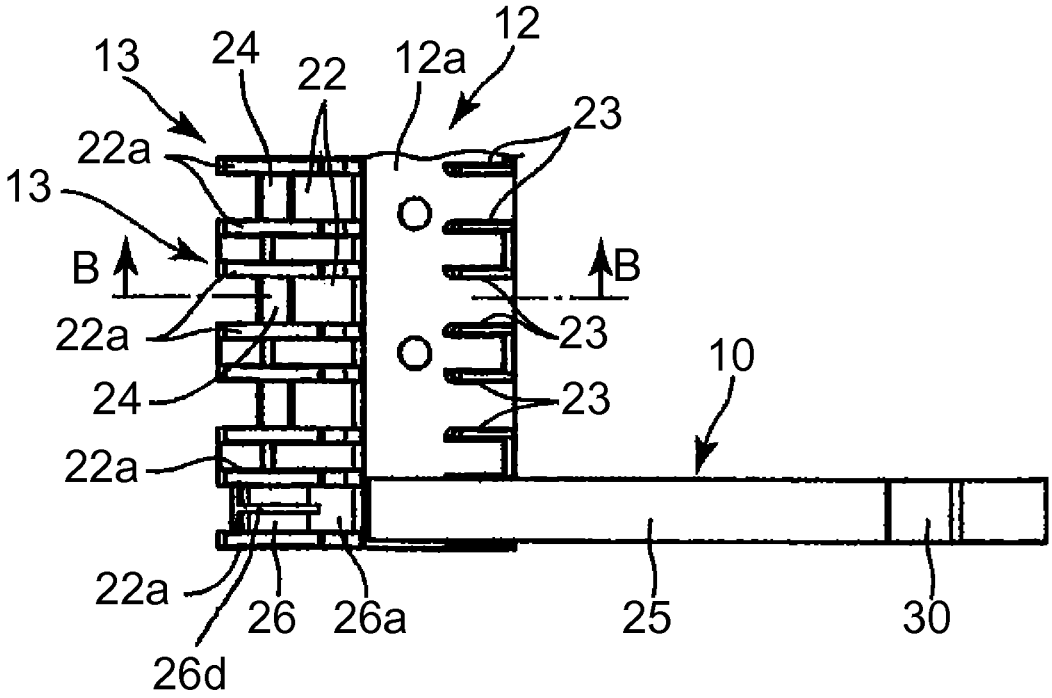
Figure 5B:
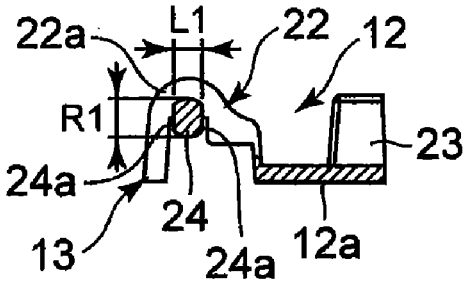

As shown in FIGS. 5A and 5B, the wippen holding members 12 are formed of a hard synthetic resin such as an ABS resin and the plurality of wippen flanges 13 are integrally formed along the key 2 arrangement direction on top of a main body plate 12*a* for approximately ten keys 2, for example. This wippen flange 13 includes an axis supporting member 22 to which the wippen 10 is attached such that the wippen 10 can freely rotate and is suppressed from horizontally oscillating, and a restricting part that restricts the horizontal oscillation of the wippen 10 during packing and transport.

In this case, as shown in FIGS. 3 and 5, the axis supporting member 22 has a pair of guiding walls 22*a* that is respectively formed on the back edge portion (left edge portion in FIG. 3) of the main body plate 12*a* of the wippen holding member 12 for each key 2, and has a wippen swing axis 24 provided between the pair of guiding walls 22*a*. The pair of guiding walls 22*a* form a guiding portion that guides the wippen engaging part 26 (explained later) of the wippen 10 such that the wippen engaging part 26 can swing while the guiding walls 22*a* sandwich the wippen engaging part 26 such that the wippen engaging part 26 can slide.

As shown in FIGS. 3 and 5, the restricting parts 23 are a pair of restricting walls that are formed on the front portion (right side portion in FIG. 3) of the main body plate 12*a* of the wippen holding member 12 so as to correspond with the respective wippens 10. As shown in FIG. 5A, the restricting part 23 guides the wippen 10 such that the wippen 10 can swing while sandwiching the lower back side portion of the wippen 10 and also restricts the horizontal oscillation of the wippen 10 during packing and transport.

As shown in FIGS. 2 and 6, the wippen 10 is formed of a hard synthetic resin such as an ABS resin, and includes the wippen main body 25 that rotates vertically in response to the depression of keys 2 and then rotates the hammer 11 vertically. The wippen also includes the wippen engaging part 26 that is integrally formed with the wippen main body 25 and that is attached to the wippen swing axis 24 of the wippen flange 13.

Figure 6A:
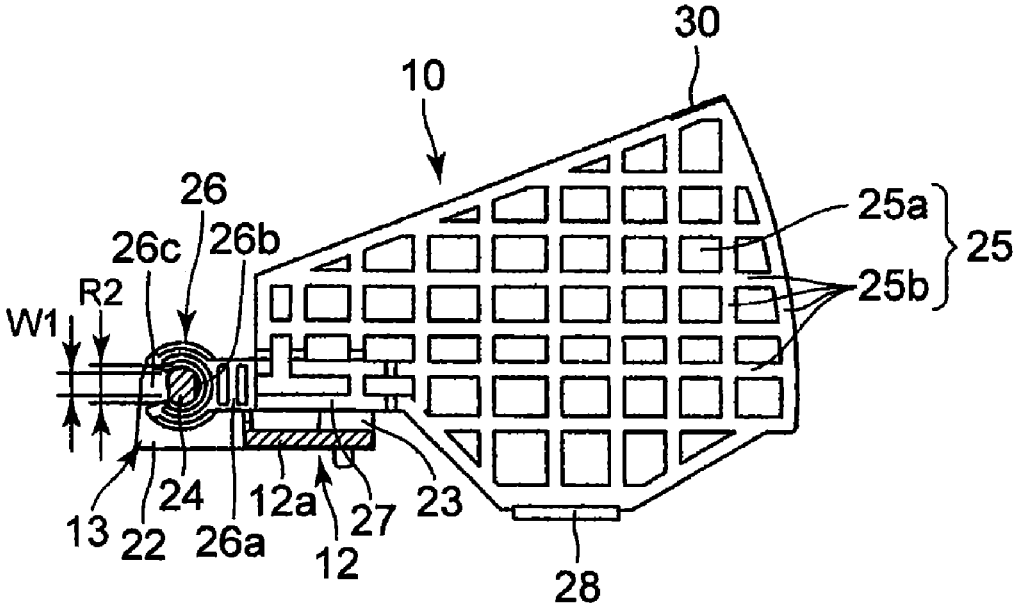
Figure 6B:
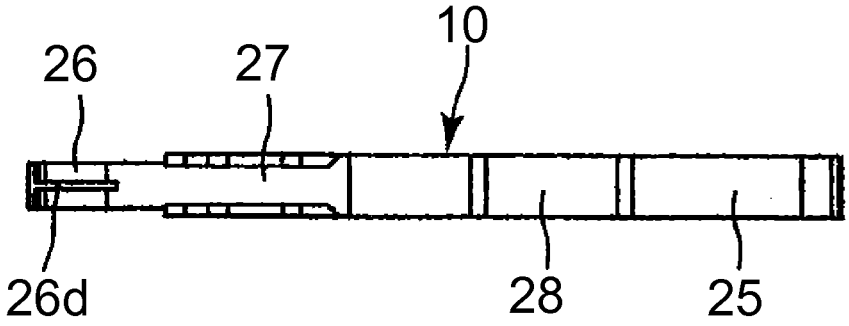

As shown in FIGS. 6A and 6B, the wippen main body 25 is formed in a waffle-like shape. In other words, the waffle shape is formed of the wippen main body 25 that has thin vertical plate portions 25*a* and a plurality of ribs 25*b* that are formed around the vertical plate portions 25*a* in a grid pattern.

As can be seen from FIGS. 6A and 6B, the wippen main body 25 is configured such that the weight of the wippen 10 can be adjusted by changing the shape of the vertical plate portions 25*a* and the density of the plurality of ribs 25*b* that are formed. In addition, the wippen main body 25 is formed such that even if the thickness of the vertical plate portion 25*a* is made thinner, the plurality of ribs 25*b* secure the strength of the structure and also prevent sink marks from occurring in the vertical plate portion 25*a* during molding.

As shown in FIGS. 6 and 7, the entire wippen engaging part 26 is formed in a reversed C shape protrusion on the back edge portion of the wippen main body 25 through a connecting neck portion 26*a*. In other words, as shown in FIG. 5A, the wippen engaging part 26 has a thickness in the key 2 arrangement direction that is approximately the same length as the gap between the pair of guiding walls 22*a* of the axis supporting member 22, and the wippen engaging part 26 is configured such that the wippen engaging part 26 can slide between the pair of guiding walls 22*a* and can be inserted therein.

As shown in FIGS. 6 and 7, the wippen engaging part 26 is formed with an engaging hole 26*b* in the center that engages the wippen swing axis 24 of the wippen flange 13 such that the wippen engaging part 26 can swing. This is done by providing an insertion opening 26*c* in the back portion of the surrounding area of the engaging hole 26*b* through which the wippen swing axis 24 can be inserted and removed, and by attaching the wippen engaging part 26 to the wippen swing axis 24 through inserting the wippen swing axis 24 into the engaging hole 26*b* via the insertion opening 26*c*.

In this case, as shown in FIG. 5B, cutouts 24*a* are formed on both front and back sides of the wippen swing axis 24 of the wippen flange 13 in a substantially vertical state such that the cutouts 24*a* are substantially perpendicular to each other. As a result, the wippen swing axis 24 is formed such that a length L1 thereof in the front to back direction (horizontal direction in FIG. 5B) is smaller than the outer diameter R1 (L1<R1) of the wippen swing axis 24. As shown in FIG. 6A, the wippen engaging part 26 is formed such that the inner diameter R2 of the engaging hole 26*b* has the same size as the outer diameter R1 of the wippen swing axis 24 (R2≈R1).

As shown in FIGS. 6 and 7, the insertion opening 26*c* of the wippen engaging part 26 is formed radially from the center of the engaging hole 26*b* to the periphery of the wippen engaging part 26. As a result, the insertion opening 26*c* is wider towards the periphery of the wippen engaging part 26 and is narrower toward the inner side or the periphery of the engaging hole 26*b*. An opening width W1 of the narrowest portion of this insertion opening 26*c*, or in other words, the portion located on the periphery of the engaging hole 26*b*, may have the same length as the length L1 of the wippen swing axis 24 in the front to back direction, but it is preferable that the length of the opening width W1 be slightly narrower (W1≤L1).

Figure 7A:
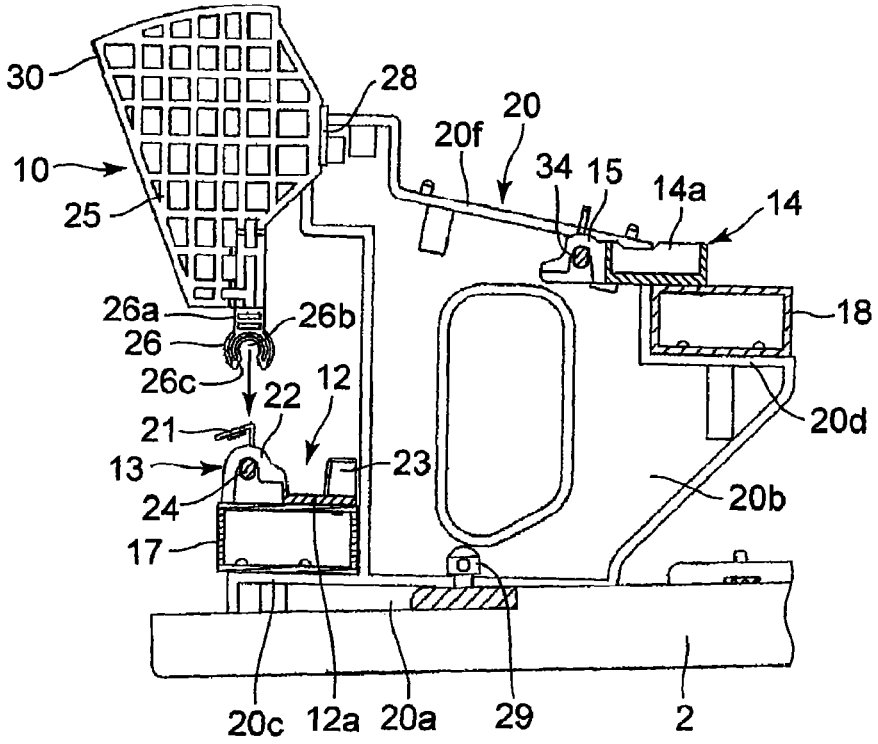

Thus, as shown in FIG. 7A, when the wippen swing axis 24 is inserted into the engaging hole 26*b* through the insertion opening 26*c*, the wippen 10 is positioned above the wippen swing axis 24 in an upright state such that the insertion opening 26*c* faces the cutout 24*a* of the wippen swing axis 24, and the insertion opening 26*c* is pressed into the cutout 24*a* of the wippen swing axis 24, slightly widening the insertion opening 26, and as a result, the wippen swing axis 24 is inserted in and engaged to the engaging hole 26*b* of the wippen engaging part 26.

As shown in FIGS. 5A and 6B, the wippen engaging part 26 is configured such that a slit 26*d* is formed in the middle portion in the thickness direction of the wippen engaging part 26 along a direction perpendicular to the axis direction of the wippen swing axis 24, or in other words, along the long side direction of the wippen 10. As a result, the wippen engaging part 26 is configured to be elastically deformed in the thickness direction thereof, which is the axis direction of the wippen swing axis 24. As a result, the wippen engaging part 26 is configured to elastically contact respective opposing faces of the pair of guiding walls 22*a* through the slit 26*d* when the wippen engaging part 26 is inserted between the pair of guiding walls 22*a*.

Meanwhile, as shown in FIGS. 6A and 6B, a thin engaging section 27 that is restricted by the restricting part 23 of the wippen holding member 12 is provided on the lower back side of the wippen main body 25 of the wippen 10. This engaging section 27 is formed by cutting out both side faces in the lower back side of the wippen main body 25 with a thickness that is substantially the same length as the gap between the pair of restricting walls of the restricting parts 23. As a result, the engaging section 27 is configured to be able to swingably guide the wippen 10 and restrict the horizontal oscillation of the wippen 10 during packing and transport by the wippen 10 being inserted between the pair of restricting walls of the restricting parts 23.

As shown in FIGS. 2 and 7, the wippen main body 25 of the wippen 10 is formed such that the lower portion thereof protrudes toward the upper surface of the key 2. A first wippen felt 28 is provided on the bottom portion of the wippen main body 25. The first wippen felt 28 is configured such that the capstan 29 provided on the upper back side of the key 2 abuts the first wippen felt 28 from the bottom side. As a result, the wippen 10 is configured to rotate counterclockwise with the wippen swing axis 24 as the center when the key 2 is depressed, and the wippen 10 is pushed upward by the capstan 29 of the key 2 that abuts the first wippen felt 28 from the bottom side.

Figure 7B:
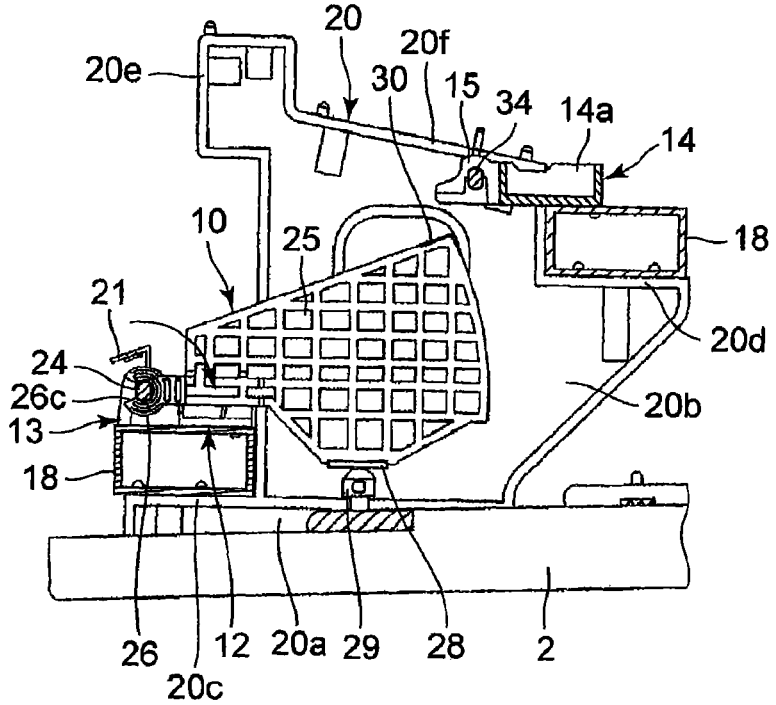

Furthermore, as shown in FIGS. 2 and 7B, the upper front portion of the wippen main body 25 of the wippen 10 is elevated compared to the upper back portion thereof, and as a result, the upper side portion of the wippen main body 25 is slanted such that the back portion is lower. A second wippen felt 30 is provided on the upper front portion of the wippen main body 25.

As shown in FIGS. 2 and 7B, the second wippen felt 30 is configured such that the hammer projection 31 (described later) of the hammer 11 is abutted from above. As a result, the wippen 10 is configured such that when the key 2 is depressed and the wippen 10 rotates counterclockwise with the wippen swing axis 24 in the center, the hammer projection 31 of the hammer 11 is pushed upward to rotate the hammer 11 clockwise.

Meanwhile, as shown in FIGS. 1 to 3, the hammer rail 18 is formed of a metal such as a steel plate or aluminum, and has a length that extends across all of the keys 2 in the key 2 arrangement direction, and the cross-section thereof is formed in a rectangular cylindrical shape in a manner similar to the wippen rail 17. The hammer rail 18 is configured such that prescribed locations thereof in the key 2 arrangement direction are attached to the respective front side rail supporting members 20*d* of the plurality of supporting members 20. On this hammer rail 18, a plurality of hammer butts 14 are attached along the arrangement direction of the keys 2.

Figure 8A:
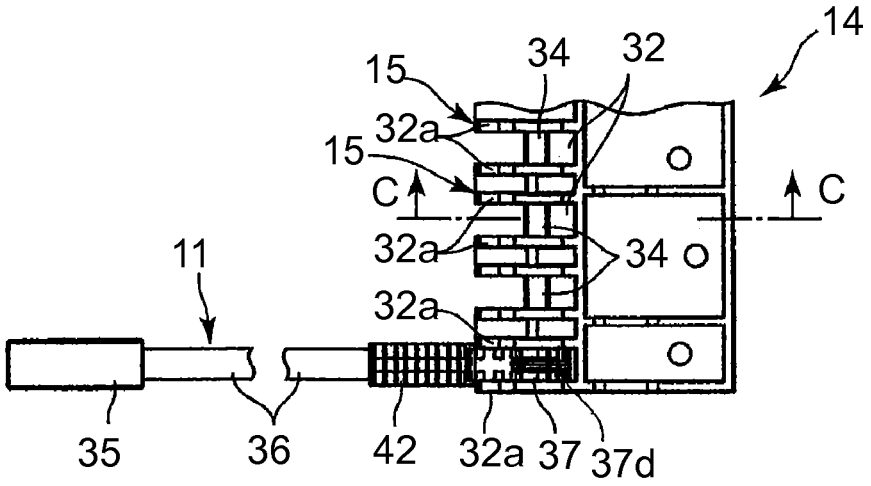
Figure 8B:
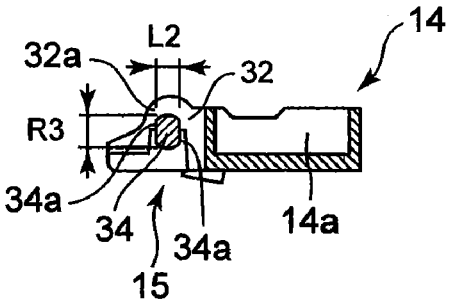

As shown in FIGS. 8A and 8B, the hammer butts 14 are formed of a hard synthetic resin such as an ABS resin and the hammer flanges 15 thereof are integrally formed along the key 2 arrangement direction for approximately ten keys 2 at the back edge portion of the main body plate 14*a* that is in a rail shape with an open upper side, for example. This hammer flange 15 has the axis supporting member 32 that the hammer 11 is attached to in a rotatable manner and that can prevent the horizontal oscillation of the hammer 11.

In this case, as shown in FIGS. 3 and 8, the axis supporting member 32 has a pair of guiding walls 32*a* that are formed for respective wippens 10 on the back edge portion (left edge portion in FIG. 3) of the main body plate 14*a* of the hammer butt 14, and a hammer swing axis 34 formed between the pair of guiding walls 32*a*. The pair of guiding walls 32*a* has a guiding portion that guides the hammer engaging part 37 of the hammer 11 in a swingable manner while sandwiching the hammer engaging part 37 (described later) from two sides such that the hammer engaging part 37 can slide.

Figure 9:
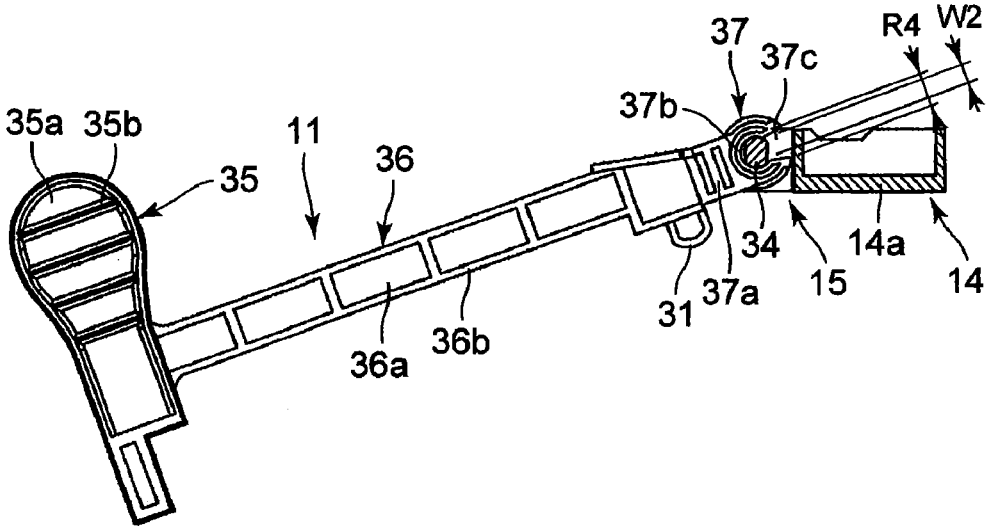
FIG. 9 is an enlarged side view showing the hammer butt and the hammer shown in FIG. 8A.

As shown in FIGS. 8 and 9, the hammer 11 is formed of a hard synthetic resin such as an ABS resin, and has the hammer portion 35 and the hammer shank 36 that are formed integrally. The hammer portion 35 has a vertical plate portion 35*a* that is in a light bulb shape, and has ribs 35*b* formed on the periphery and on both side faces thereof. The hammer shank 36 has a horizontal plate portion 36*a* in which the length in the front to back direction thereof is substantially the same length as the wippen 10, and the ribs 36*b* are formed on the periphery and both side faces of the hammer shank 36.

As shown in FIGS. 8 and 9, the front edge portion (right edge portion in FIG. 9) of the hammer shank 36 has the hammer engaging part 37 that is attached to the axis supporting member 32 of the hammer butt 14 in a rotatable manner. This hammer engaging part 37 is formed in a C shape similar to the wippen engaging part 26, and is formed as a protrusion protruding towards the front from the front edge portion of the hammer shank 36 through the connecting neck portion 37*a*. In other words, the hammer engaging part 37 is formed with a thickness in the key 2 arrangement direction that is substantially the same in length with the gap between the pair of guiding walls 32*a* of the axis supporting member 32, and the hammer engaging part 37 can be inserted into the gap between the guiding walls 32*a* such that the hammer engaging part 37 can slide.

As shown in FIGS. 8 to 10, the hammer engaging part 37 has an engaging hole 37*b* in the center that engages the hammer swing axis 34 of the hammer flange 15, and has an insertion opening 37*c* to which the hammer swing axis 34 can be inserted or removed in a portion of the periphery of the engaging hole 37*b*, or in other words, on the front portion of the periphery of the engaging part 37, and the hammer engaging part 37 is attached to the hammer swing axis 34 in a swingable manner by inserting the hammer swing axis 34 into the engaging hole 37*b* through the insertion opening 37*c*.

Figure 10A:
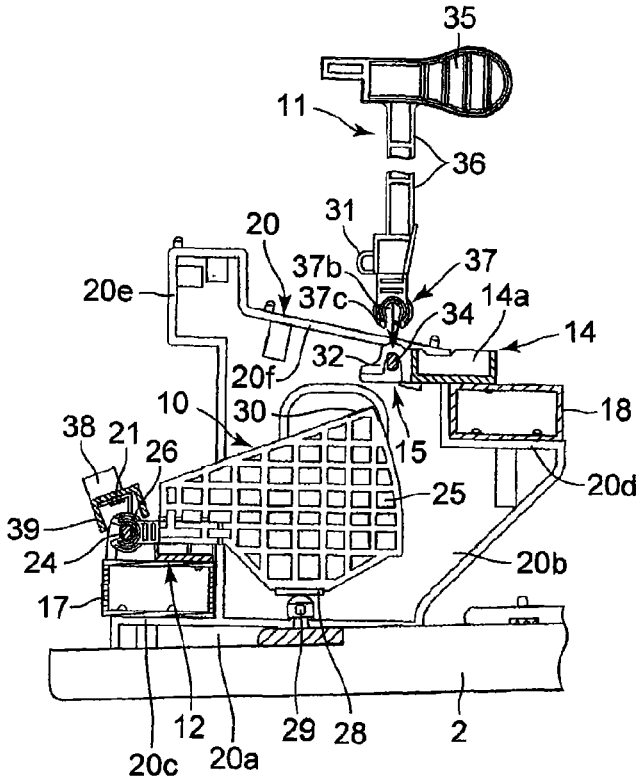

In this case, as shown in FIGS. 8 to 10, the hammer swing axis 34 of the hammer flange 15 has cutouts 34*a* in a substantially perpendicular state on both sides in the front to back direction so as to be substantially perpendicular to each other. As a result, the hammer swing axis 34 is formed such that a length L2 thereof in the front to back direction (horizontal direction in FIG. 8B) is smaller than the outer diameter R3 (L2<R3) of the hammer swing axis 34. As shown in FIG. 10A, the hammer engaging part 37 is formed such that the inner diameter R4 of the engaging hole 37*b* is the same size as the outer diameter R3 of the hammer swing axis 34 (R4≈R3).

As shown in FIGS. 9 and 10, the insertion opening 37*c* of the hammer engaging part 37 is formed radially from the center of the engaging hole 37*b* to the periphery of the hammer engaging part 37. As a result, the insertion opening 37*c* is formed in a similar manner to the insertion opening 26*c* of the wippen engaging part 2, i.e., the opening towards the periphery of the hammer engaging part 37 is wider and the opening towards the inside which is also the periphery of the engaging hole 37*b* is narrower. An opening width W2 of the narrowest portion of this insertion opening 37*c*, or in other words, the portion located on the periphery of the engaging hole 37*b*, may have the same length as the length L2 of the hammer swing axis 34 in the front to back direction, but it is preferable that the length of the opening width W2 be slightly narrower (W2≤L2).

As a result, as shown in FIGS. 9 and 10, the hammer engaging part 37 is configured such that when the hammer swing axis 34 is inserted into the engaging hole 37*b* through the insertion opening 37*c*, the hammer 11 is positioned above the hammer swing axis 34 in an upright state such that the insertion opening 37*c* faces the cutout 34*a* of the hammer swing axis 34, and the insertion opening 37*c* is pressed into the cutout 34*a* of the hammer swing axis 34, slightly widening the insertion opening 37*c*, and as a result, the hammer swing axis 34 is inserted in and engaged to the engaging hole 37*b* of the hammer engaging part 37.

As shown in FIG. 8A, the hammer engaging part 37 is configured such that a slit 37*d* is formed in the middle portion in the thickness direction of the hammer engaging part 37 along a direction perpendicular to the axis direction of the hammer swing axis 34, or in other words, along the long side direction of the hammer 11. As a result, the hammer engaging part 37 is configured to be elastically deformed in the thickness direction thereof which is the axis direction of the hammer swing axis 34. As a result, the hammer engaging part 37 is configured to elastically contact with respective opposing faces of the pair of guiding walls 32*a* through the slit 37*d* when the hammer engaging part 37 is inserted between a pair of guiding walls 32*a*.

As shown in FIGS. 9 and 10, on the lower front edge portion of the hammer shank 36, a hammer projection 31 that abuts the second wippen felt 30 provided on the upper front edge portion of the wippen main body part 25 of the wippen 10 from above. As a result, the hammer 11 is configured to rotate clockwise about the hammer swing axis 34 of the hammer flange 15 when the hammer projection 31 is pushed upward in response to the wippen 10 rotating counterclockwise.

Figure 10B:
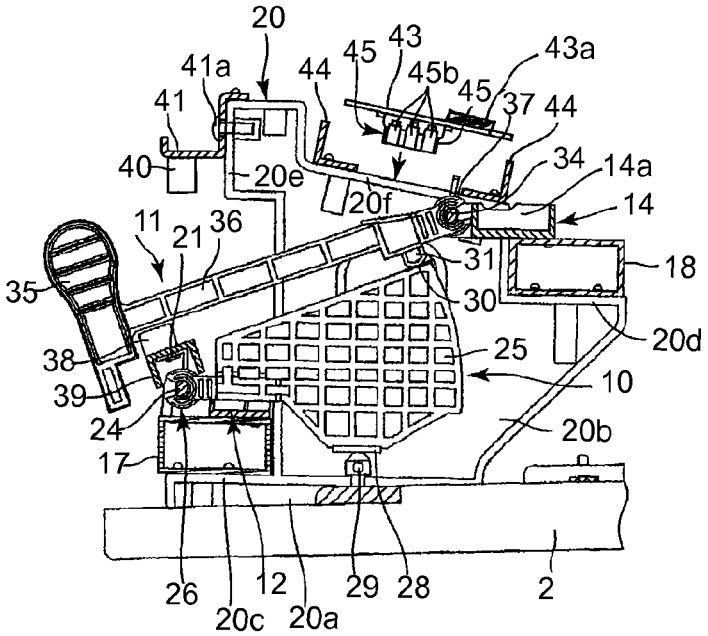

As shown in FIGS. 2 and 10B, the hammer shank 36 is configured such that the initial position, which is the lower limit position, is restricted by the hammer rest 38 abutting the lower back edge portion of the hammer shank 36. In other words, the hammer rest 38 is attached to a hammer rest rail 39 supported by the plurality of stopper supporting members 21 provided on the wippen rail 17. In this case, as shown in FIGS. 10A and 10B, the plurality of stopper supporting members 21 are formed such that the respective upper portions thereof are slanted downward towards the back portion.

As shown in FIGS. 1 and 10, the hammer rest rail 39 is formed of a metal such as a steel plate or aluminum, for example, and is formed in a rail shape with the bottom side thereof being open, and has a length that extends across all of the keys 2 in the key 2 arrangement direction. This hammer rest rail 39 is attached on top of the respective plurality of stopper supporting members 21 such that the hammer rest rail 39 is inclined downward towards the back portion. As a result, the hammer rest 38 is attached on the hammer rest rail 39 such that the hammer rest 38 is inclined downward towards the back portion. Therefore, the initial position of the hammer 10 that is inclined downward toward the back is restricted by the hammer shank 36 thereof abutting the hammer rest 38 from above.

In addition, as shown in FIGS. 2 and 10B, the hammer shank 36 is configured such that the upper limit position thereof is restricted by the upper back edge thereof abutting the upper limit stopper 40. In other words, this upper limit stopper 40 is attached to the bottom surface of the upper limit stopper rail 41 that is attached to the respective stopper rail supporting part 20*e* of the plurality of supporting members 20.

In this case, as shown in FIGS. 2 and 10B, the upper limit stopper rail 41 is formed of a steel plate, or a metal such as aluminum, and is a plate having a substantially L shaped cross-section. In addition, the upper limit stopper rail 41 has a length that extends across all of the keys 2 in the key 2 arrangement direction. The vertical portion of the upper limit stopper rail 41 is attached to the respective stopper rail supporting parts 20*e* by a vis 41*a* while the horizontal portion of the upper limit stopper rail 41 protrudes towards the back from the respective stopper rail supporting part 20*e* of the plurality of support members 20.

As shown in FIGS. 2 and 10B, the upper limit stopper 40 is provided on the bottom surface of the horizontal portion of the upper limit stopper rail 41. As a result, the upper limit position of the hammer 10 is restricted by the upper back edge portion of the hammer shank 36 abutting the upper limit stopper 40 from the bottom when the hammer shank 36 rotates clockwise with the hammer swing axis 34 of the hammer flange 15 as the center.

As shown in FIGS. 2 and 10B, a switch pressing part 42 is formed on the upper front edge portion of the hammer shank 36. A switch substrate 43 is disposed in a position above the switch pressing part 42 of the hammer shank 36 through a pair of substrate support rails 44. The pair of substrate support rails 44 are formed such that a cross-section thereof has an L shape, and each of the substrate support rails 44 has a length that extends across all of the keys 2 in the key 2 arrangement direction.

As shown in FIGS. 2 and 10B, the pair of substrate support rails 44 is formed of a steel plate or a metal such as aluminum, and the horizontal portions thereof are respectively attached to the substrate rail supporting part 20*f* of the supporting member 20 with a prescribed gap between the two substrate support rails 44. As shown in FIG. 1, the switch substrate 43 is divided into parts. In other words, in this embodiment, the switch substrate 43 is divided into four parts each having a length corresponding to approximately 20 keys 2 and each being attached to the pair of substrate support rails 44, for example.

As shown in FIGS. 1, 2, and 10B, a rubber switch 45 is provided on the bottom surface of each of the switch substrates 43. This rubber switch 45 has a rubber sheet that extends along the key 2 arrangement direction and a bulged portion 45*a* with a reversed dome shape formed on the rubber sheet for each of the plurality of hammer shanks 36. A plurality of moving contacts 45*b* are formed along the front to back direction of the hammer shank 36 in the bulged portion 45*a*. The moving contacts can contact with or detach from a plurality of fixed contacts (not shown) that are provided on the bottom surface of the switch substrate 43.

As shown in FIG. 2, the rubber switch 45 is configured to send a switch signal corresponding to the strength in which the key 2 is depressed. Here, the depressing of the key 2 causes the plurality of moving contacts 45*b* to contact the plurality of fixed contacts one after another after the hammer 11 rotates clockwise with the hammer swing axis 34 of the hammer flange 15 as the center. Then, the hammer shank 36 pushes the switch pressing part 42 from the bottom side, and elastically deforms the reverse dome shaped bulged portion 45*a*. A sound source 43*a* provided on the switch substrate 43 generates a sound signal in response to the switch signal and the speaker (not shown) generates a sound based on the sound signal.

Next, the assembly of the keyboard device 1 of this type of electronic keyboard instrument is described.

First, the plurality of keys 2 and the plurality of supporting members 20 are provided on the base plate 5. In this case, as shown in FIGS. 1 and 2, 88 keys 2 are attached and arranged in a line on the base plate 5 with the balance pins 4*a* and 4*b* such that the keys 2 can swing in the vertical direction. In addition, the supporting members 20 are placed on both end portions of the base plate 5 in the key 2 arrangement direction and are provided in three locations between the respective keys 2 for every twenty keys 2.

As shown in FIG. 3, next, the wippen rail 17 is attached across the entire length of the plurality of keys 2 in the key 2 arrangement direction on the respective back side rail supporting members 20*c* of the plurality of supporting members 20, and the plurality of wippen holding members 12 and the plurality of stopper supporting members 21 are attached on the wippen rail 17 along the key 2 arrangement direction.

In this case, the plurality of stopper supporting members 21 that are protruding upward are attached above the wippen rail 17 at five locations that respectively correspond to the plurality of supporting members 20. In a similar manner, the hammer rail 18 is attached on the respective front side rail supporting member 20*d* and is disposed along the entire length of the plurality of keys 2 in the key 2 arrangement direction, and a plurality of hammer holding members 14 are attached on the hammer rail 18 along the key 2 arrangement direction.

Then, the plurality of wippens 10 are respectively attached on the wippen flanges 13 of the plurality of wippen holding members 12 one after another. In this case, as shown in FIG. 7A, the wippen 10 is positioned above the wippen flange 13 in an upright state such that the insertion opening 26*c* of the wippen engaging part 26 faces the wippen swing axis 24, and the wippen swing axis 24 engages the engaging hole 26*b* by being pressed into the insertion opening 26*c*.

The insertion opening 26*c* can engage the wippen swing axis 24 with ease because the insertion opening 26*c* of the wippen engaging part 26 is wider toward the outside and narrower toward the inside. Furthermore, when the wippen swing axis 24 engages the insertion opening 26*c*, the cutout 24*a* of the wippen swing axis 24 slightly widens the insertion opening 26*c* and thereby allowing the wippen swing axis 24 to swingably engage the engaging hole 26*b* through the insertion opening 26*c*. Then, the wippen 10 is rotated clockwise with the wippen swing axis 24 as the center.

During this step, when the wippen engaging part 26 is inserted between the pair of guiding walls 22*a* of the axis supporting member 22, the wippen engaging part 26 is in elastic contact with and sandwiched by the respective opposing faces of the pair of guiding walls 22*a* through the slit 26*d* of the wippen engaging part 26. As a result, the wippen 10 does not horizontally oscillate in the key 2 arrangement direction. Furthermore, at this time, the first wippen felt 28 on the bottom portion of the wippen 10 abuts the capstan 29 of the key 2 from above, thereby restricting the initial position of the wippen 10.

In this case, the engaging section 27 provided on the lower back side portion of the wippen 10 is inserted between the pair of restricting walls that are the restricting parts 23 of the wippen flange 15. In addition, the engaging section 27 rotatably guides the wippen 10 and restricts the wippen 10 from horizontally oscillating in the key 2 arrangement direction during packing and transport. In this situation, the wippen engaging part 26 does not indeliberately break away from the wippen swing axis 24 through the insertion opening 26*c*, because the insertion opening 26*c* of the wippen engaging part 26 corresponds to the cutout 24*a* of the wippen swing axis 24.

In other words, first, the plurality of wippens 10 are positioned in an upright state respectively facing the wippen flanges 13 of the wippen holding members 12, and then the wippen engaging parts 26 of the wippen 10 are respectively engaged to the wippen swing axes 24 of the wippen flange 13 one after another so as to respectively attach the plurality of wippens 10 to the wippen flange 13 one after another. This attaching process is performed in a similar manner for the respective wippen flanges 13 of the plurality of wippen holding members 12. As a result, all of the wippens 10 that respectively correspond to all of the keys 2 are attached.

Next, the hammer rest rail 39 is attached to the upper portion of the plurality of stopper supporting members 21, and then the hammer rest 38 is attached on top of the hammer rest rail 39. After that, the plurality of hammers 11 are respectively attached to the hammer flanges 15 of the plurality of hammer butts 14. In this case, as shown in FIG. 10A, the hammer 11 is positioned above the hammer flange 15 in an upright state such that the insertion opening 37*c* of the hammer engaging part 37 faces the hammer swing axis 34 of the hammer flange 15, and the hammer swing axis 2 34 engages the engaging hole 37*b* by being pressed into the insertion opening 37*c*.

The insertion opening 37*c* is wider towards the periphery of the hammer engaging part 37 and is narrower towards the inside, and thus the insertion opening 37*c* can engage the hammer swing axis 34 with ease. When the hammer swing axis 34 is inserted into the insertion opening 37*c*, the hammer swing axis 34 engages the engaging hole 37*b* through the insertion opening 37*c* as the insertion opening 37*c* is slightly widened by the cutout 34*a* of the hammer swing axis 34.

When the hammer engaging part 37 is inserted between the pair of guiding walls 32*a* of the axis supporting member 32, the hammer engaging part 37 is in elastic contact with and sandwiched by the respective opposing faces of the pair of guiding walls 22*a* through the slit 37*d* of the hammer engaging part 37. As a result, the hammer 11 swings in the vertical direction without horizontally oscillating in the key 2 arrangement direction.

Next, the hammer 11 is rotated counterclockwise with the hammer swing axis 34 as the center. Then, the hammer projection 31 of the hammer 11 abuts the second wippen felt 30 of the wippen 10 from above and the lower back portion of the hammer shank 36 abuts the hammer rest 38 from above. As a result, the hammer 11 is restricted in an initial position with a downward inclination from front to back.

In this manner, first, the plurality of hammers 11 are each set in an upright position corresponding to each of the hammer flanges 15. Then, each of the hammer engaging parts 37 of the hammer 11 is engaged to each of the hammer swing axes 34 of the hammer flange 15 one after another to serially engage each of the plurality of hammers 11 to each of the hammer flanges 15 of the hammer butt 14. This attaching process is performed in a similar manner for the respective hammer flanges 15 of the plurality of hammer butts 14. As a result, all of the hammers 11 that respectively correspond to all of the keys 2 are attached.

Then, the upper limit stopper rail 41 is attached to the respective stopper rail supporting parts 20*e* of the plurality of supporting members 20. Furthermore, a pair of substrate support rails 44 is attached with a prescribed gap therebetween on the respective substrate rail supporting parts 20*f* of the plurality of supporting members 20, and then the plurality of switch substrates 43 is attached on the pair of substrate support rails 44 along the key 2 arrangement direction.

In this case, the rubber switch 45 is attached to the bottom surface of the switch substrate 43 in advance. In addition, when the switch substrate 43 is attached on the pair of substrate support rails 44, each of the bulged portions 45*a* of the rubber switch 45 is made to correspond to each of the switch pressing parts 42 of the plurality of hammer shanks 36.

Next, the effects of the keyboard device 1 of this type of electronic keyboard instrument are described.

This keyboard device 1 is played by depressing the keys 2. At this time, if the key 2 is depressed, the key 2 swings clockwise with the balance pins 4*a* and 4*b* as the center, and the capstan 29 of the key 2 pushes the wippen 10 upward. As a result, the wippen 10 swings counterclockwise with the wippen swing axis 24 of the wippen flange 13 as the center.

At this point, the wippen swing axis 24 of the wippen flange 13 is engaged to the engaging hole 26*a* of the wippen engaging part 26, and therefore, the wippen 10 does not shift in the front to back direction of the keys 2 and the wippen 10 rotates smoothly with the wippen swing axis 24 as the center. In addition, at this point, the wippen engaging part 26 of the wippen 10 is guided by being sandwiched between the pair of guiding walls 22*a* of the wippen flange 13 in a rotatable manner, and thus the wippen 10 does not horizontally oscillate and swings smoothly in the vertical direction.

In this manner, when the wippen rotates counterclockwise by being pushed upward by the capstan 29 of the key 2, the second felt 30 of the wippen 10 pushes the hammer projection 31 of the hammer 11 upward. As a result, the hammer 11 swings clockwise with the hammer swing axis 34 of the hammer flange 15 as the center and applies an action load to the key 2.

At this point, in a similar manner to the wippen 10, the hammer swing axis 34 of the hammer flange 15 is engaged to the engaging hole 37*a* of the hammer engaging part 37 of the hammer 11, and thus, the hammer 11 smoothly swings with the hammer swing axis 34 as the center without shifting in the front to back direction of the keys 2. In addition, at this point, the hammer engaging part 37 of the hammer 11 is guided by being sandwiched between the pair of guiding walls 32*a* of the hammer flange 15 in a swingable manner. Therefore, the hammer engaging part 37 of the hammer 11 is guided through being sandwiched between the pair of guiding walls 32*a* of the hammer flange 15 in a swingable manner, and thus, the hammer 11 does not horizontally oscillate and swings smoothly in the vertical direction.

When the hammer 11 swings clockwise with the hammer swing axis 34 as the center, an action load is applied to the key 2 by the moment of inertia of the hammer 11. In other words, the hammer shank 36 is formed having substantially the same length as the length of the wippen 10 in the front to back direction of the key 2, and the hammer portion 35 is formed on the back edge portion of the hammer shank 36. At this point, the engaging part 37 of the front edge portion of the hammer shank 36 is swingably attached to the hammer swing axis 34.

When the hammer 11 swings clockwise with the hammer swing axis 34 as the center, an action load is applied to the key 2 by the moment of inertia of the hammer 11. As a result, a touch of the keys very similar that of an acoustic piano can be obtained.

In this manner, when the hammer 11 swings clockwise with the hammer swing axis 34 as the center, then the switch pressing part 42 of the hammer shank 36 pushes the reverse dome shaped bulged portion 45*a* of the rubber switch 45 provided on the switch substrate 43 from the bottom side. Thus, the reverse dome shaped bulged portion 45*a* elastically deforms and the plurality of moving contacts 45*b* in the bulged portion 45*a* contacts the plurality of fixed contacts one after another to output a switch signal depending on the strength of the depression of the key 2. As a result, a sound is generated by the speaker (not shown).

Then, when the hammer 11 swings further clockwise with the hammer swing axis 34 as the center, the upper back edge portion of the hammer shank 36 abuts the upper limit stopper 40 from the bottom side, thereby restricting the swing of the hammer 11. Next, when the key 2 starts being released, the wippen 10 swings clockwise and returns to the initial position and the hammer 11 rotates counterclockwise and returns to the initial position.

In this manner, an electronic keyboard instrument that is easy to assemble, has high productivity, and has low cost can be produced by the action mechanism 3 of this electronic keyboard instrument having: the plurality of keys 2 aligned, the plurality of wippens 10 that respectively swing in the vertical direction according to the depressing of the plurality of the keys 2, the plurality of hammers 11 that applies an action load to the respective plurality of keys 2 by respectively swinging in the vertical direction according to the swinging action of the plurality of wippens 10, and the wippen holding member 12 having the plurality of wippen flanges 13 that are integrally formed along the key 2 arrangement direction and that swingably holds the plurality of wippens 10.

In other words, with the action mechanism 3 of this electronic keyboard instrument, the respective plurality of wippen flanges 13 that swingably holds the respective plurality of wippens 10 do not need to be manufactured and assembled individually before attaching the plurality of wippens 10 to the wippen holding member 12, and the plurality of wippen flanges 13 can be disposed at once by just installing the wippen holding member 12. As a result, because the assembly process is easier, the productivity improves and the cost is reduced.

In this case, each of the plurality of wippen flanges 13 of the wippen holding members 12 has the wippen swing axis 24 and each of the wippens 10 has the wippen engaging part 26 that can be swingably attached to the wippen swing axis 24 from a direction perpendicular to the axis direction. Therefore, the assembly productivity is excellent because the wippen 10 can be attached to the wippen flange 13 with ease by simply inserting the wippen engaging part 26 of the wippen 10 to the wippen swing axis 24 of the wippen flange 13 from the direction perpendicular to the axis direction.

In other words, the pair of cutouts 24*a* are provided on both sides of the wippen swing axis 24 of the wippen flange 13 in a substantially perpendicular state parallel to each other, the engaging hole 26*b* is formed in the center of the wippen engaging part 26 of the wippen 10, and the insertion opening 26*c* is formed in the periphery of the engaging hole 26*b*. As a result, the wippen 10 can be attached to the wippen flange 13 with ease by the wippen swing axis 24 engaging the engaging hole 26*b* of the wippen engaging part 26 through the insertion opening 26*c* of the wippen engaging part 26 from above in the perpendicular direction along the pair of cutouts 24*a* formed on both side portions of the wippen swing axis 24.

In this case, the wippen swing axis 24 has a length L1 in the front to back direction that is smaller than the outer diameter R1 of the wippen swing axis 24. The wippen engaging part 26 is formed such that the inner diameter R2 of the engaging hole 26*b* has the same size as the outer diameter R1 of the wippen swing axis 24, and the opening width W1 of the narrowest portion of this insertion opening 26*c* is slightly narrower than the length L1 of the wippen swing axis 24 in the front to back direction. As a result, when the wippen swing axis 24 is inserted into the engaging hole 26*b* through the insertion opening 26*c* of the wippen engaging part 26, the wippen swing axis 24 engages the engaging hole 26*b* by being pressed into the insertion opening 26*c* and the cutout 24*a* of the wippen swing axis 24 slightly widening the insertion opening 26*c*.

Thus, even if the wippen holding members 12 having the plurality of wippen flanges 13 formed along the key 2 arrangement direction are installed before the plurality of wippens 10 are attached to the wippen holding members 12, the wippens 10 can be respectively attached to the plurality of wippen flanges 13 one after another with ease, thereby making the assembly process easier and improving the productivity. In this case, the insertion opening 26*c* can engage the wippen swing axis 24 with ease because the insertion opening 26*c* of the wippen engaging part 26 is wider toward the outside and narrower toward the inside, thereby making the assembly process easier and improving the productivity.

In addition, through providing the pair of guiding walls 22*a* that prevent horizontal oscillation of the wippen 10 on the wippen flange 13, the wippen engaging part 26 of the wippen 10 is swingably attached to the wippen swing axis 24 of the wippen flange 13, thereby slidably sandwiching the wippen engaging part 26 with the pair of guiding walls 22*a*. In this case, the slit 26*d* is formed along the long side direction of the wippen 10 in the wippen engaging part 26, and when the wippen engaging part 26 is inserted between the pair of guiding walls 22*a*, the wippen engaging part 26 can be can be elastically in contact with the pair of guiding walls 22*a* in a slidable manner through the slit 26*d*.

As a result, with this action mechanism 3, when the wippen 10 swings according to key depression, the pair of guiding walls 22*a* of the wippen flange 13 prevents the wippen 10 from horizontally oscillating in the key 2 arrangement direction, and therefore the wippen 10 can be smoothly swung in an excellent manner and the positional accuracy and the operating accuracy of the wippen 10 can be improved.

Furthermore, the restricting part 23 that restricts the horizontal position of the wippen 10 is provided on the wippen flange 13 and the restricting part 23 is a pair of restricting walls that are formed on the main body plate 12*a* of the wippen holding member 12, and is configured to restrict the horizontal position of the wippen 10 while sandwiching the engaging section 27 in which both side faces thereof on the lower back side portion of the engaging section 27 of the wippen 10 is cut out, and the wippen 10 can be swingably guided and the position of the wippen 10 can be excellently restricted without the wippen 10 horizontally oscillating during packaging and transport.

In addition, an electronic keyboard instrument that is easy to assemble, has high productivity, and has low cost can be produced by the action mechanism 3 of this electronic keyboard instrument having: the plurality of keys 2 aligned, the plurality of wippens 10 that respectively swing in the vertical direction according to the depressing of the plurality of the keys 2, the plurality of hammers 11 that applies an action load to the respective plurality of keys 2 by respectively swinging in the vertical direction according to the swinging action of the plurality of wippens 10, and the hammer flange 14 having the plurality of hammer butts 15 that are integrally formed along the key 2 arrangement direction and that swingably holds the plurality of hammers 11.

In other words, with the action mechanism 3 of this electronic keyboard instrument, the respective plurality of hammer flanges 15 that swingably holds the respective plurality of hammers 11 do not need to be manufactured and assembled individually before attaching the plurality of hammers 11 to the hammer butt 14, and the plurality of hammer flanges 15 can be disposed at once by just installing the hammer butt 14. As a result, because the assembly process is easier, the productivity improves and the cost is reduced.

In this case, each of the plurality of hammer flanges 15 of the hammer butt 14 has the hammer swing axis 34 and each of the hammers 11 has the hammer engaging part 37 that can be swingably attached to the hammer swing axis 34 from a direction perpendicular to the axis direction. Therefore, the assembly productivity is excellent because the hammer 11 can be attached to the hammer flange 15 with ease by simply inserting the hammer engaging part 37 of the hammer 11 to the hammer swing axis 34 of the hammer flange 15 from the direction perpendicular to the axis direction.

In other words, the pair of cutouts 34*a* are provided on both sides of the hammer swing axis 34 of the hammer flange 15 in a substantially perpendicular state parallel to each other, the engaging hole 37*b* is formed in the center of the hammer engaging part 37 of the hammer 11, and the insertion opening 37*c* is formed in the periphery of the engaging hole 37*b*. As a result, the hammer 11 can be attached to the hammer flange 15 with ease by the hammer swing axis 34 engaging the engaging hole 37*b* of the hammer engaging part 37 through the insertion opening 37*c* of the hammer engaging part 37 from above in the vertical direction along the pair of cutouts 34*a* formed on both side portions of the hammer swing axis 34.

In this case, the hammer swing axis 34 has the length L2 in the front to back direction that is smaller than the outer diameter R3 of the hammer swing axis 34, the hammer engaging part 37 is formed such that the inner diameter R4 of the engaging hole 37*b* has the same size as the outer diameter R3 of the hammer swing axis 34, and the opening width W2 of the narrowest portion of this insertion opening 37*c* is slightly narrower than the length L2 of the hammer swing axis 34 in the front to back direction. As a result, when the hammer swing axis 34 is inserted into the engaging hole 37*b* through the insertion opening 37*c* of the hammer engaging part 37, the hammer swing axis 34 engages the engaging hole 37*b* by being pressed into the insertion opening 37*c* and the cutout 34*a* of the hammer swing axis 34 slightly widening the insertion opening 37*c*.

Thus, even if the hammer butts 14 having the plurality of hammer flanges 15 formed along the key 2 arrangement direction are installed before the plurality of hammers 11 are attached to the hammer butts 14, the hammers 11 can be respectively attached to the plurality of hammer flanges 15 one after another with ease, thereby making the assembly process easier and improving the productivity. In this case, the insertion opening 37*c* is wider towards the periphery of the hammer engaging part 37 and is narrower towards the inside, and thus the insertion opening 37*c* can engage the hammer swing axis 34 with ease, and thereby making the assembly process easier and improving the productivity.

In addition, because the hammer flange 15 has the pair of guiding walls 32*a* that prevents the hammer 11 from horizontally oscillating, if the hammer engaging part 37 of the hammer 11 is swingably attached to the hammer swing axis 34 of the hammer flange 15, the hammer engaging part 37 can be sandwiched by the pair of guiding walls 32*a* such that the hammer engaging part 37 can slide. In this case, because the slit 37*d* is formed along the long side direction of the hammer 11, when the hammer engaging part 37 is inserted between the pair of guiding walls 32*a*, the hammer engaging part 37 can be elastically in contact with the pair of guiding walls 32*a* through the slit 37*d* such that the hammer engaging part 37 can slide.

As a result, with this action mechanism 3, when the hammer 11 swings according to key depression, the pair of guiding walls 32*a* of the hammer flange 15 prevents the hammer 11 from horizontally oscillating in the key 2 arrangement direction, and therefore the hammer 11 can be smoothly swung in an excellent manner and the positional accuracy and the operating accuracy of the hammer 11 can be improved.

This action mechanism 3 includes the wippen rail 17 that is disposed along the key 2 arrangement direction and that has the wippen holding member 12, and the hammer rail 18 that is disposed along the key 2 arrangement direction and that has the hammer butt 14. Therefore, the wippen holding member 12 that is the plurality of wippen flanges 13 that are integrally formed in the key 2 arrangement direction can be attached on the wippen rail 17 one after another, and the hammer butt 14 that is the plurality of hammer flanges 15 that are integrally formed in the key 2 arrangement direction can be attached to the hammer rail 18 one after another, thereby simplifying the assembly process.

Furthermore, this action mechanism 3 of the electronic keyboard instrument includes the plurality of supporting members 20 that support the wippen rail 17 and the hammer rail 18, and the plurality of supporting members 20 allow the wippen rail 17 and the hammer rail 18 to stably and reliably run the entire length of the plurality of keys 2 in the key 2 arrangement direction in an excellent manner, and thus the plurality of wippens 10 and the plurality of hammers 11 can be reliably attached in an excellent manner.

Figure 11A:
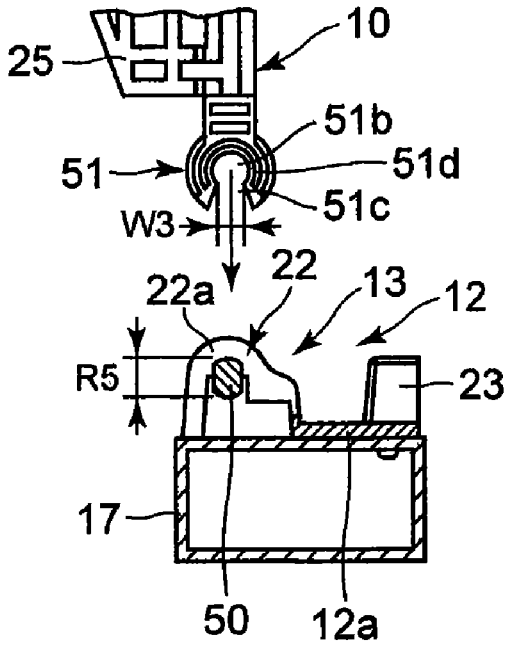
Figure 11B:
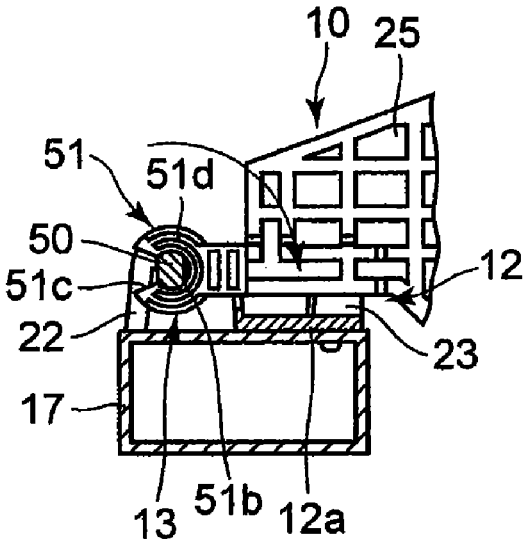

In the embodiment mentioned above, the cutouts 24*a* are formed on both sides of the wippen swing axis 24 provided on each of the wippen flanges 13 of the wippen holding member 12, and the engaging hole 26*b* is formed in the center of the wippen engaging part 26 of the wippen 10, and the insertion opening 26*c* is formed in a portion of the periphery of the wippen engaging part 26, and the insertion openings 26*c* is slightly widened by the cutout 24*a* of the wippen swing axis 24 by being pressed in such that the wippen swing axis 24 is engaged to the engaging hole 26*b*, but the configuration is not limited to this, and may include a configuration for Modification Example 1 that is shown in FIGS. 11A and 11B, for example.

In Modification Example 1, the wippen swing axis 50 that is provided on each of the plurality of wippen flanges 13 of the wippen holding member 12 is formed in a cylindrical shape having a circular cross-section, the engaging hole 51*b* is formed in the center of the wippen engaging part 51 of the wippen 10, the insertion opening 51*c* is formed in a portion of the periphery of the wippen engaging part 51, and the wippen engaging part 51 is configured to elastically deform in the radial direction thereof.

In this case, the wippen engaging part 51 is configured to elastically deform in the radial direction by having an arc-shaped slit 51*d* along the periphery of the engaging hole 51*b*. As a result, even if the width W3 of the narrowest portion of the insertion opening 51*c* is formed smaller than the outer diameter R5 of the wippen swing axis 50, the wippen engaging part 51 is configured to elastically deform in the radial direction of the engaging hole 51*b* when the wippen swing axis 50 is being inserted.

As shown in FIGS. 11A and 11B, in Modification Example 1, when the wippen swing axis 50 is inserted into the engaging hole 51*b* through the insertion opening 51*c* of the wippen engaging part 51, the wippen 10 can be inserted into the insertion opening 51*c* of the wippen engaging part 51 from any direction perpendicular to the axis direction of the wippen swing axis 50.

Furthermore, in the first Modification Example 1, when the wippen swing axis 50 is inserted into the insertion opening 51*c* of the wippen engaging part 51, because the wippen engaging part 51 can be elastically deformed in an excellent manner by the insertion opening 51*c* thereof being widened in the radial direction, the wippen swing axis 50 can be reliably inserted into the engaging hole 51*b* in an excellent manner, and the wippen engaging part 51 deforms back to the original shape and can elastically engage the wippen holding axis 50. Therefore, the wippen 10 can be swingably attached to the wippen swing axis 50 in an excellent manner with the wippen swing axis 50 as the center.

Figure 12A:
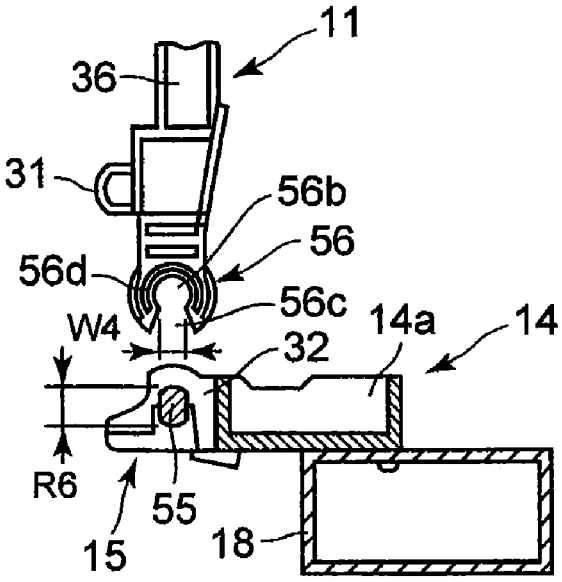
Figure 12B:
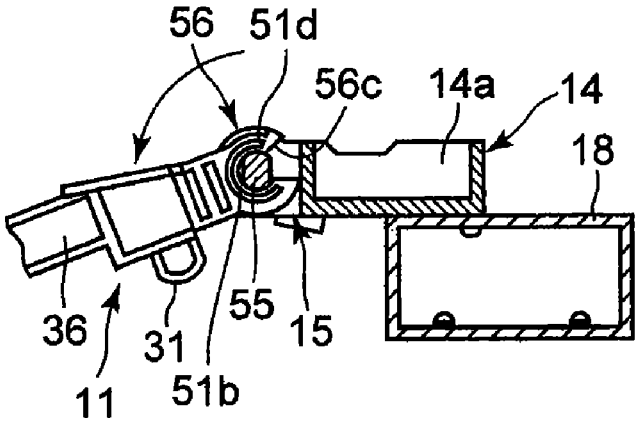

In addition, in the embodiment mentioned above, the cutouts 34*a* are formed on both sides of the hammer swing axis 34 provided on each of the hammer flanges 15 of the hammer butt 14, and the engaging hole 37*b* is formed in the center of the hammer engaging part 37 of the hammer 11, and the insertion opening 37*c* is formed in a portion of the periphery of the hammer engaging part 37, and the insertion openings 37*c* is slightly widened by the cutout 34*a* of the wippen swing axis 34 by being pressed in such that the wippen swing axis 34 is engaged to the engaging hole 37*b*, but the configuration is not limited to this, and may include a configuration for the Modification Example 2 that is shown in FIGS. 12A and 12B, for example.

In the Modification Example 2, the hammer swing axis 55 that is provided on each of the plurality of hammer flanges 15 of the hammer butt 14 is formed in a cylindrical shape having a circular cross-section, the engaging hole 56*b* is formed in the center of the hammer engaging part 56 of the hammer 11, the insertion opening 56*c* is formed in a portion of the periphery of the hammer engaging part 56, and the hammer engaging part 56 is configured to elastically deform in the radial direction thereof.

In this case, the hammer engaging part 56 is configured to elastically deform in the radial direction by having an arc-shaped slit 56*d* along the periphery of the engaging hole 56*b*. As a result, even if the width W4 of the narrowest portion of the insertion opening 56*c* is formed smaller than the outer diameter R6 of the hammer swing axis 55, the hammer engaging part 56 is configured to elastically deform in the radial direction of the engaging hole 56*b* when the hammer swing axis 55 is being inserted.

As shown in FIGS. 12A and 12B, in Modification Example 2, when the hammer swing axis 55 is inserted into the engaging hole 56*b* through the insertion opening 56*c* of the hammer engaging part 56, the hammer 11 can be inserted into the insertion opening 56*c* of the hammer engaging part 56 from any direction perpendicular to the axis direction of the hammer swing axis 55.

Furthermore, in Modification Example 2, when the hammer swing axis 55 is inserted into the insertion opening 56*c* of the hammer engaging part 56, because the hammer engaging part 56 can be elastically deformed in an excellent manner by the insertion opening 56*c* thereof being widened in the radial direction, the hammer swing axis 55 can be reliably inserted into the engaging hole 56*b* in an excellent manner, and the hammer engaging part 56 deforms back to the original shape and can elastically engage the hammer holding axis 55. Therefore, the hammer 11 can be swingably attached to the hammer swing axis 55 in an excellent manner with the hammer swing axis 50 as the center.

Figure 13:
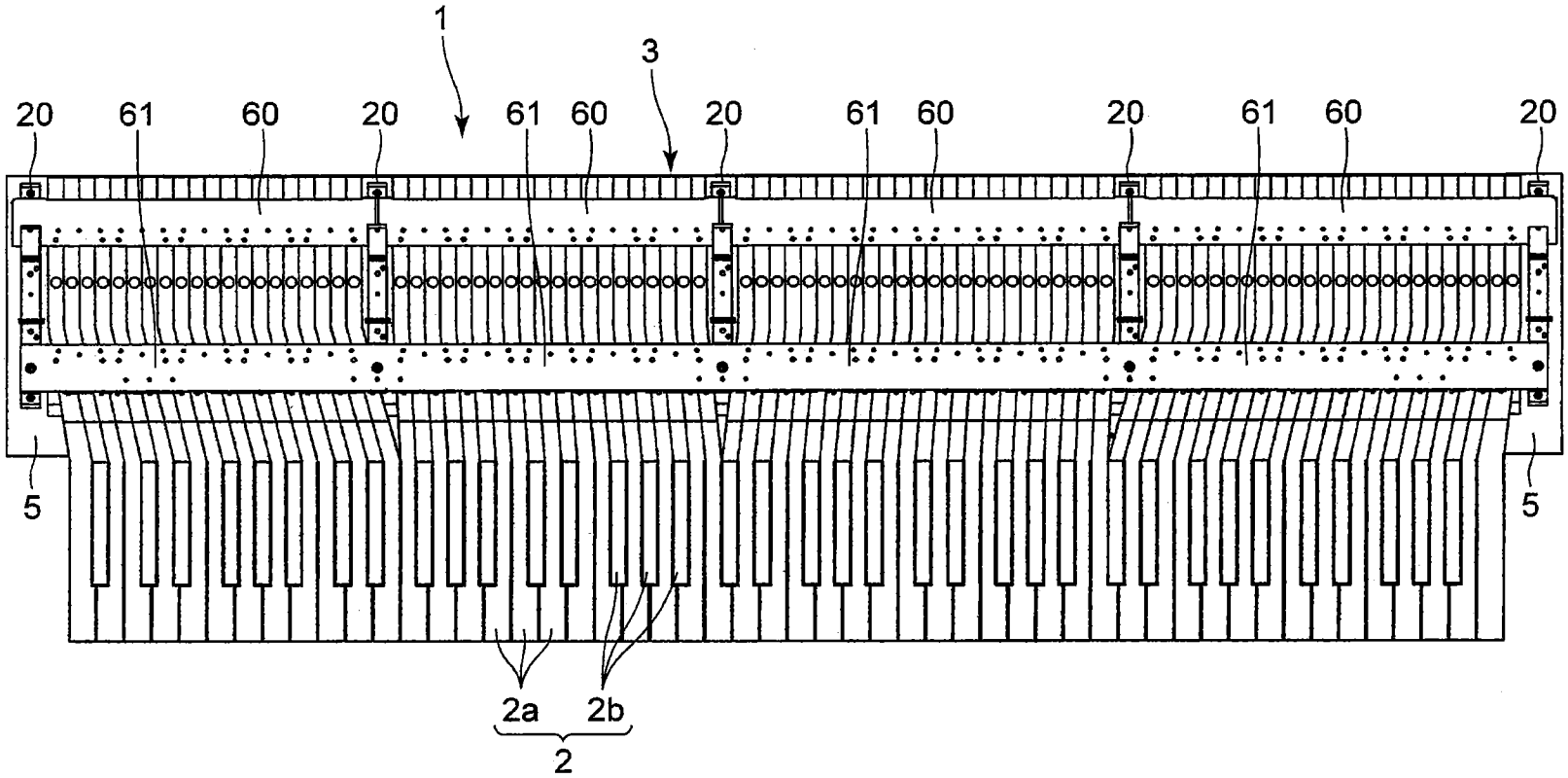
FIG. 13 is a plan view showing a Modification Example 3 of the keyboard instrument of one aspect of the present invention in which the wippen rail and the hammer rail are respectively divided into a plurality of wippen rails and hammer rails.

Furthermore, in the embodiment mentioned above, a case in which the wippen rail 17 and the hammer rail 18 are formed across the entire length of the plurality of keys 2 in the key 2 arrangement direction has been described, but the present invention is not limited to this and may have a configuration such as that of Modification Example 3 shown in FIG. 13 in which the wippen rail 60 and the hammer rail 61 are respectively divided into several parts that are provided along the entire length of the plurality of keys 2 in the key 2 arrangement direction.

In this case, the wippen rail 60 and the hammer mil 61 may be divided into four, three, or two parts (each having half the length of the action mechanism 3 in the key 2 arrangement direction) in positions corresponding to respective groups of the supporting members 20. Furthermore, in a similar manner, the hammer rest rail 39 and the upper limit stopper rail 41 may both be divided into four, three, or two parts (each having half the length of the action mechanism 3 in the key 2 arrangement direction) in positions corresponding to respective groups of the supporting members 20.

Also, in the embodiment mentioned above, a case in which the plurality of wippen flanges 13 are integrally formed with the wippen holding members 12 such that each of the plurality of wippen flanges 13 is provided for approximately ten of the keys 2 and the plurality of hammer flanges 15 are integrally formed with the hammer holding members 14 such that each of the plurality of wippen flanges 13 is provided for approximately ten of the keys 2, but the present invention is not limited to this, and each of the plurality of wippen flanges 13 and each of the plurality of hammer flanges 15 may be integrally formed for any number of the keys 2 such as twenty or five.

In addition, the wippen is not limited to those that swing, but may be configured to shift (move) when the key is depressed to transfer the force of the depression.

An embodiment of one aspect of the present invention was described above, but the present invention is not limited thereto, and encompasses the present invention stated in the claims and their equivalents. It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A keyboard device, comprising:

a plurality of keys; and a plurality of key action mechanisms respectively provided for the plurality of keys, wherein each of said key action mechanisms includes:

a first shaft;

a pressing force transmit member that couples with the first shaft, and receives a pressing force from the corresponding key when the key is depressed so as to swing around the first shaft in response to a depression of the corresponding key;

a second shaft; and a hammer that couples with the second shaft, wherein the pressing force transmit member interfaces the hammer so that the hammer applies a load to the key through the pressing force transmit member when the key is depressed.

2. The keyboard device according to claim 1, wherein the first shafts are formed as a unitary shaft extending along a direction in which the plurality of keys are arranged.

3. The keyboard device according to claim 2, wherein the pressing force transmit member has a slit formed therein along a direction pointing towards a first end of the pressing force transmit member, and is inserted to the first shaft from a direction perpendicular to a direction in which the first shaft extends.

4. The keyboard device according to claim 2, wherein the pressing force transmit member has, at a center thereof, an engaging hole that engages the first shaft, and wherein the pressing force transmit member has an opened passage extending from the engaging hole to an exterior through which the first shaft is inserted.

5. The keyboard device according to claim 2, wherein the first shaft has a guiding portion that prevents the pressing force transmit member from oscillating in a direction parallel to the first shaft.

6. The keyboard device according to claim 1, further comprising:

a rail disposed along a direction in which the plurality of keys are arranged, the first shafts being attached to the rail.

7. The keyboard device according to claim 6, further comprising:

a plurality of brackets provided on locations prescribed along an entire length of the plurality of keys in the direction in which the plurality of keys are arranged, said plurality of brackets supporting the rail.

8. A keyboard instrument, comprising:

the keyboard device according to claim 1;

a plurality of switches respectively provided for the plurality of keys of the keyboard device according to claim 1, each switch generating an ON signal by being depressed in response to the swinging of the corresponding hammer; and a sound source that generates a sound signal in response to the ON signal provided by the switch.

9. The keyboard instrument according to claim 8, further comprising:

a switch rail extending across an entire length of the plurality of keys in a direction in which the plurality of keys are arranged, said switch rail having the plurality of switches provided thereon such that the plurality of switches respectively correspond to the hammers.

10. The keyboard device according to claim 1, wherein the second shafts are formed as a unitary shaft extending along a direction in which the plurality of keys are arranged.

11. The keyboard device according to claim 10, wherein the hammer has a hammer butt that couples with the second shaft, and a hammer head at a side opposite to the hammer butt, and wherein the hammer butt has a slit formed therein along a direction pointing towards the hammer head of the hammer, and is inserted to the second shaft from a direction perpendicular to a direction in which the second shaft extends.

12. The keyboard device according to claim 11, wherein the hammer butt of the hammer has, at a center thereof, an engaging hole that engages the second shaft, and wherein the hammer butt has an opened passage extending from the engaging hole to an exterior through which the second shaft is inserted.

13. The keyboard device according to claim 1, wherein the second shaft has a guiding portion that prevents the hammer from oscillating in a direction parallel to the second shaft.

14. The keyboard device according to claim 1, further comprising:

a hammer rail disposed along a direction in which the plurality of keys are arranged, the second shafts being attached to the hammer rail.

15. The keyboard device according to claim 14, further comprising:

a plurality of brackets provided on locations prescribed along an entire length of the plurality of keys in the direction in which the plurality of keys are arranged, said plurality of brackets supporting the hammer rail.

16. A keyboard instrument, comprising:

the keyboard device according to claim 15;

a plurality of switches respectively provided for the plurality of keys of the keyboard device, each switch generating an ON signal by being depressed in response to the swinging of the corresponding hammer; and a sound source that generates a sound signal in response to the ON signal provided by the switch.

17. The keyboard instrument according to claim 16, further comprising:

a switch rail having the switch provided thereon such that the plurality of switches respectively correspond to the hammers.

18. The keyboard device according to claim 1, wherein the first shaft is stationary and has a circular cross-section with flattened sides, and the first shaft has a center defining an axis of rotation for the pressing force transmit member, wherein the pressing force transmit member has a C-shaped receptacle that is semicircular in cross section, and an opening that is sized for insertion of the C-shaped receptacle over the flattened sides of the first shaft so that, when the C-shaped receptacle and the pressing force transmit member are rotated, the first shaft and the C-shaped receptacle are held together, wherein the second shaft is stationary and has a circular cross-section with flattened sides, and the second shaft has a center defining an axis of rotation for the hammer, and wherein the hammer butt of the hammer has a C-shaped receptacle that is semicircular in cross section, and an opening that is sized for insertion of the C-shaped receptacle over the flattened sides of the second shaft so that, when the C-shaped receptacle and the hammer are rotated, the second shaft and the C-shaped receptacle of the hammer are held together.

* * * * *